US005544887A

United States Patent [19]

Bryant

[11] Patent Number: 5,544,887

[45] Date of Patent: Aug. 13, 1996

[54] GOLF PUTTER TRAINING DEVICE

[76] Inventor: Judy Bryant, 16 Maple St., Arlington, Mass. 02174

[21] Appl. No.: 508,925

[22] Filed: Jul. 28, 1995

[51] Int. Cl.[6] ..... A63B 69/36

[52] U.S. Cl. ..... 473/230; 16/29; 16/30

[58] Field of Search ..... 273/174, 186.1, 273/186.2, 186.3, 194 R, 194 A, 167 A

[56] References Cited

U.S. PATENT DOCUMENTS

| | | | |
|---|---|---|---|
| 2,255,332 | 9/1941 | Russell | 273/174 |
| 2,426,274 | 8/1947 | Kramer | 273/174 |
| 3,680,868 | 8/1972 | Jacob | 273/174 |
| 4,535,992 | 8/1985 | Slagle | 273/194 A |
| 5,411,263 | 5/1995 | Schmidt et al. | 273/164.1 |

*Primary Examiner*—George J. Marlo
*Attorney, Agent, or Firm*—Weingarten, Schurgin, Gagnebin & Hayes

[57] ABSTRACT

A golf putter training device that includes a removeably attachable bracket and a roller mounted in the bracket. In one embodiment, the invention features a golf putter comprising a bracket removeably attachable to the bottom surface of a putter and a roller mounted in the bracket. The bracket of the training device is held onto the bottom face of the club head by mounting pins that fit into outwardly facing holes in the bottom surface of the putter. The bracket that holds the roller may be fabricated of a flexible material, such as spring steel or plastic. The roller is approximately 70% the length of the club head to provide friction to alert the user to a misaligned putting stroke.

6 Claims, 2 Drawing Sheets

GOLF PUTTER TRAINING DEVICE

FIELD OF THE INVENTION

This invention relates to golf putters, and more particularly to golf putters incorporating a removable training device.

BACKGROUND OF THE INVENTION

Developing a proper putting stroke requires hours of practice and patience. Golfers at both beginning and intermediate skill levels are advised to learn the proper putting stroke techniques in order to establish good form and lower their golf scores.

Proper putting technique requires maintaining the club head perpendicular to the desired line of travel of the ball throughout the putting stroke. Deviations from perpendicular head contact result in the ball veering off to one side or the other. In order to achieve the proper stroke, beginning golfers are instructed to move their arms in a pendulum-like motion and to maintain their hands in a fixed position holding the club head perpendicular to the line of sight to the cup. In order to more easily learn this stroke technique, U.S. Pat. No. 5,411,263 to Schmidt et al. shows a putter having a control rail projecting downwardly from a bottom wall to engage the turf and stabilize the head against twist during the head downward placement. However, such a design does not provide feedback to the golfer to alert him that his stroke is not perfectly perpendicular with the desired line of travel of the ball. In addition, the rail shown by Schmidt et al. is a permanent fixture of the putter head and may not be removed once proper stroke technique has been mastered.

SUMMARY OF THE INVENTION

The present invention is directed to a golf putter training device which may be used on the golf course or in the home. The invention features a bracket removeably attachable to a bottom surface of a golf putter head and a roller mounted in the bracket. The bracket that holds the roller may be fabricated of a flexible material, such as spring steel or plastic. The roller used in the training device of the invention is approximately 70% the length of the club head.

In one embodiment, the invention features a golf putter comprising a bracket removeably attachable to the bottom surface of said putter and a roller mounted in the bracket. The bracket of the training device is held onto the bottom face of the club head by mounting pins that fit into outwardly facing holes in the bottom surface of the putter. In use, the training device of the invention provides feedback to the user to indicate that the putting stroke is not perpendicular with the desired line of travel of the ball. The feedback allows the user to correct the misalignment through practice and results in a perfectly perpendicular club face and better putting technique.

DESCRIPTION OF THE DRAWINGS

The invention will be more fully understood from the following detailed description taken in conjunction with the accompanying drawings in which.

DETAILED DESCRIPTION OF THE INVENTION

Figure 1:
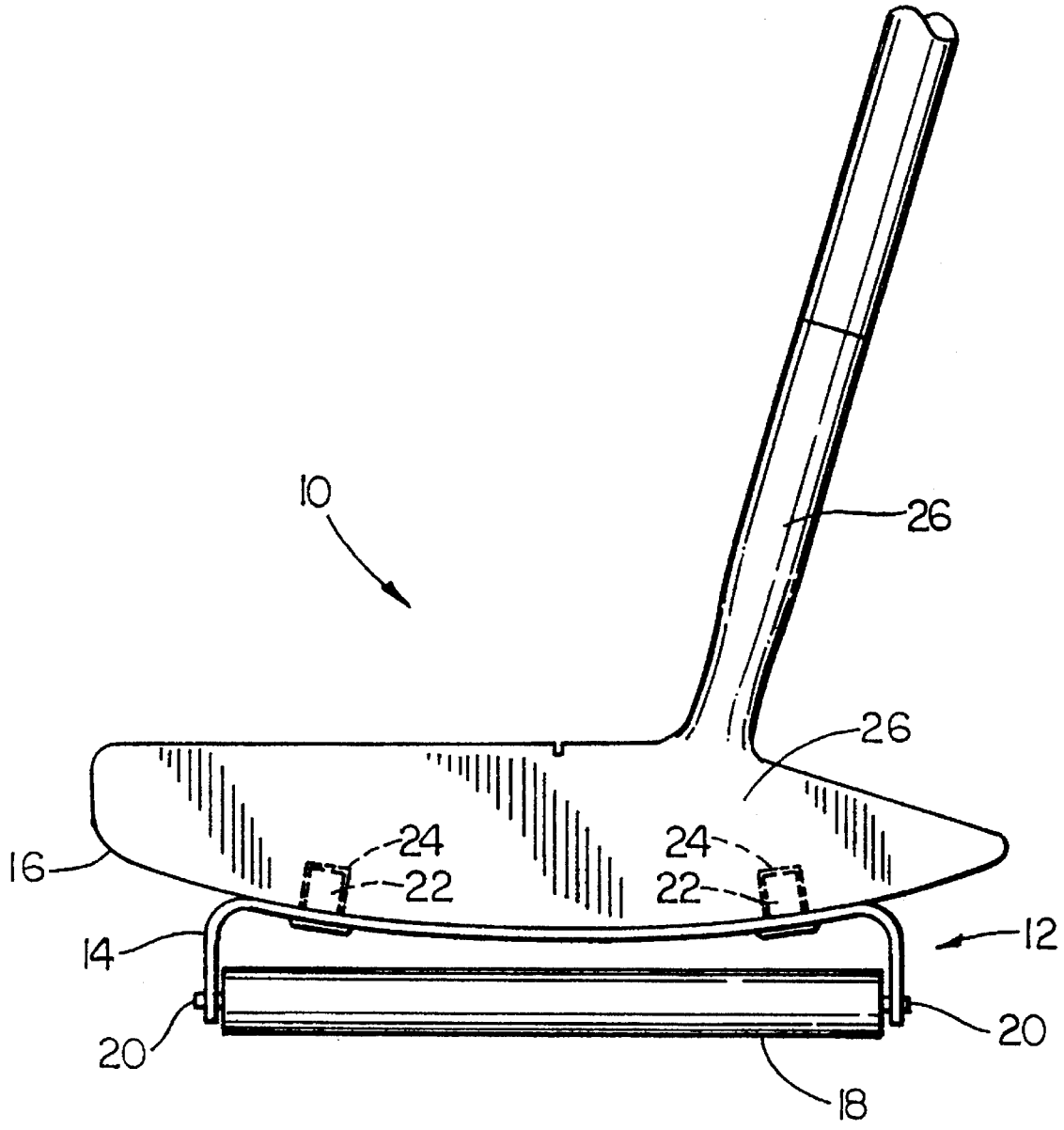
FIG. 1 is a front view of a putter head incorporating the present invention.
Figure 2:
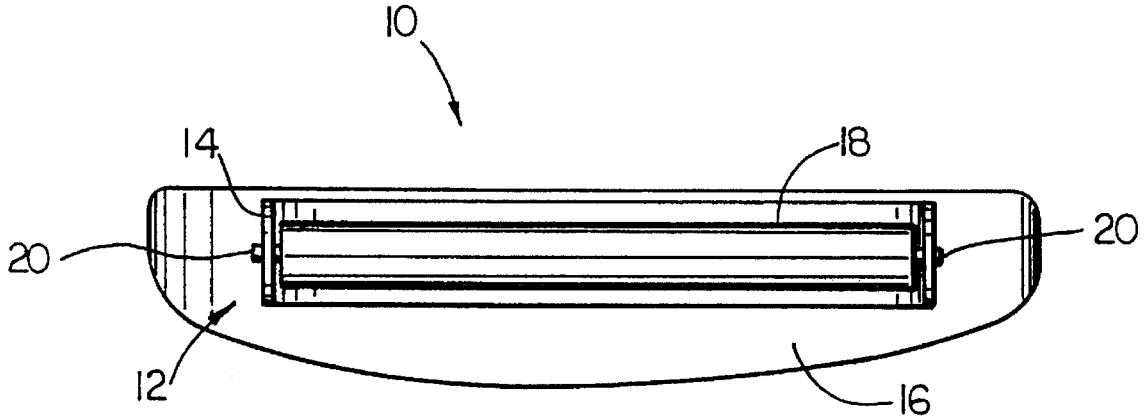
FIG. 2 is a bottom view of a putter head incorporating the present invention.

FIGS. 1 and 2 show front and bottom views, respectively, of a club head 10 incorporating the training device 12 of the invention. The training device 12 includes a mounting bracket 14 attached to the bottom surface 16 of the club head and a roller 18 mounted within the bracket. The roller 18 includes a pair of mounting pins 20, one on each end of the roller, that insert into holes on opposite ends of the bracket and allows the roller 18 to rotate freely when mounted in the bracket 14.

The face of the bracket 14 that confronts the bottom surface of the club head 16 is shaped to conform to the curvature of the bottom surface of the club head 16. The bracket 14 is fabricated of flexible materials, such as spring steel, plastic, or other suitable material, so that the training device may be attached to the bottom surface of the club head 16 by friction as described hereinbelow. The bracket 14 is also fabricated so that the front face of the club head 26 is at the proper height for striking the golf ball while the roller 18 rolls along the ground. Generally, a preferred putter is selected for its comfort and feel, and accommodation may be made in the bottom surface of the putter head to accept the training device of the invention. Such accommodation may include drilling holes or other types of apertures in the bottom face 16 of the club head as described herein below. The angle at which the neck of the shaft 26 connects the club head may also be varied in order to suit particular users.

The roller 18 is approximately 70% the length of the club head and may be fabricated of any lightweight, durable material such as hollow brass, plastic, graphite and other suitable materials. Use of lightweight materials in the design and fabrication of the training device is desirable to minimize added weight and maintain the "feel" of the putter while the training device is in use. Use of a roller 18 of approximately 70% of the length of the club head is desirable in order to provide adequate feedback to indicate whether the user's stroke is out of alignment with the intended direction of travel of the ball, but there is no specific limit on its length. Further, the training device is attached to the club head such that the center of the roller is aligned with the center ("sweet spot") of the club head for maximum effectiveness and control.

Figure 3:
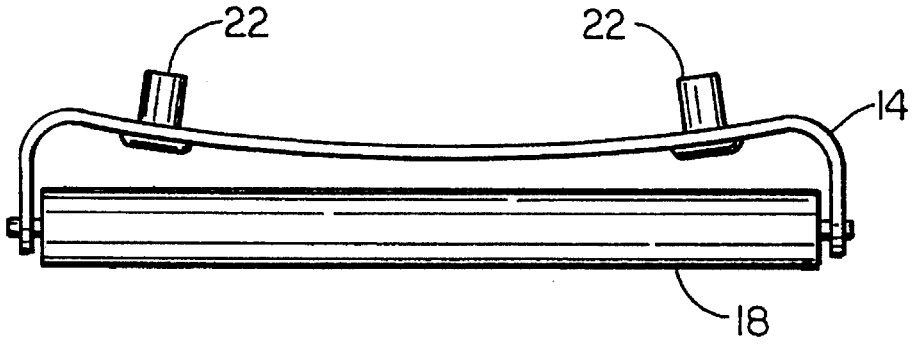
FIG. 3 is a side view of the removable training device of the invention.

The training device of the invention 12 is removable from the club head. This removable configuration provides the user with an opportunity to practice his putting stroke using the training device of the invention, and then remove the training device prior to making the final putt. As shown in FIG. 3, the training device 12 is attached to the club head by at least two fasteners 22. In one embodiment, as illustrated in FIG. 3, a pair of upwardly projecting mounting pins 22 are fastened to each end of the bracket 14. The mounting pins, in turn, are received into outwardly facing mounting holes 24 recessed into the bottom face 16 of the club head (most easily seen in FIG. 1).

In combination with the flexible nature of the bracket 14, the mounting pins 22 are held in the mounting holes 24 by friction. When mounted, the bracket 14 is placed under tension and thereby forces the mounting pins 22 against the sides of the mounting holes 24, thus holding the bracket in place. The training device is removed by relieving the tension of the flexible bracket 14 and pulling firmly in a downward motion to dislodge the mounting pins 22 from the holes 24. In one embodiment, the mounting pins 22 are smooth-sided to facilitate easy installation and removal of the training device. However, other fastening means, such as screws, magnets, or similar removable fastening means, may also be implemented.

In use, a perfectly aligned, perpendicular putting stroke will result in minimal friction from the roller as it rolls along the ground. Any deviation or misalignment from a perfectly perpendicular stroke will result in friction by the roller 18 as it drags along the ground and which can be felt by the user. The user will subsequently adjust his stroke or hand position on the club to correct for the misalignment. The training device is versatile so that it may be used on the golf course, or in the home.

The invention offers the addition psychological advantage that when the training device is in use, it cannot be seen by the user during the putting stroke because the top of the club head covers the device. Accordingly, when the device is removed, the appearance of the club head is unchanged and the psychological effect of putting without the device is alleviated.

Although the invention has been shown and described with respect to an illustrative embodiment thereof, it should be appreciated that the foregoing and various other changes, omissions, and additions in the form and detail thereof may be made without departing from the spirit and scope of the invention as delineated in the claims.

I claim:

1. A golf putter, comprising:

a putter head having a bottom surface;

a generally U-shaped resilient bracket removeably attached to said bottom surface of said putter head by coacting resiliently engaged male and female members, respectively, attached to said bracket and said bottom surface, said bracket projecting below said bottom surface of said golf putter head; and a cylindrical roller mounted between the downwardly extending arms of said U-shaped bracket;

wherein said cylindrical roller provides directional feedback to a user to indicate a misaligned putt during a putting stroke.

2. The golf putter of claim 1, wherein said flexible material is spring steel.

3. The golf putter of claim 1, wherein said flexible material is plastic.

4. The golf putter of claim 1, wherein the length of said roller is approximately 70% the length of the club head.

5. The golf putter of claim 1, wherein said female members further comprise outwardly facing holes in said bottom surface of said putter.

6. The golf putter of claim 1, wherein said male members comprise at least two mounting pins.

* * * * *

UNITED STATES PATENT AND TRADEMARK OFFICE

CERTIFICATE OF CORRECTION

PATENT NO. : 5,544,887

DATED : August 13, 1996

INVENTOR(S) : Judy Bryant

It is certified that error appears in the above-indentified patent and that said Letters Patent is hereby corrected as shown below:

Column 4, claim 2, lines 17-18, "wherein said flexible material is spring steel." should read --wherein said generally U-shaped resilient bracket comprises spring steel.--.

Column 4, claim 3, lines 19-20, "wherein said flexible material is plastic." should read --wherein said generally U-shaped resilient bracket comprises plastic.--.

Signed and Sealed this

Twenty-fourth Day of March, 1998

*Attest:*

Bruce Lehman

BRUCE LEHMAN

*Attesting Officer*

*Commissioner of Patents and Trademarks*